US006263814B1

(12) United States Patent
O'Connor

(10) Patent No.: US 6,263,814 B1
(45) **Date of Patent: *Jul. 24, 2001**

(54) STRIP OF MATERIAL WITH SPLICES AND PRODUCTS FORMED THEREFROM

(75) Inventor: Lawrence J. O'Connor, Manitoba (CA)

(73) Assignee: BKI Holding Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/203,665

(22) Filed: Dec. 1, 1998

Related U.S. Application Data

(63) Continuation-in-part of application No. 08/889,737, filed on Jul. 8, 1997, now Pat. No. 5,927,051, and a continuation-in-part of application No. 09/081,826, filed on May 20, 1998, now Pat. No. 5,987,851.

(51) Int. Cl.[7] ..... B32B 7/08

(52) U.S. Cl. ..... 112/401; 112/400-441; 112/470.16; 428/33; 428/57; 428/102; 428/124; 428/176; 428/181; 156/157; 270/37; 270/39.01; 270/40; 242/556; 53/429; 53/16; 53/117; 53/434; 53/435; 53/513; 53/520; 53/157; 493/413; 493/414; 493/415; 493/410; 493/411; 493/437; 493/448; 493/439; 493/440; 493/357; 493/356; 493/363; 206/494; 206/524.8

(58) Field of Search ..... 112/400–441; 428/33, 57, 102, 124, 176, 181; 156/157; 270/37, 39.01, 40

(56) References Cited

U.S. PATENT DOCUMENTS

| | | | |
|---|---|---|---|
| 32,761 | | 7/1861 | Elliot . |
| 1,029,459 | | 6/1912 | Quigley . |
| 1,463,918 | | 8/1923 | Borroughs . |
| 1,489,833 | | 4/1924 | Keller . |
| 1,677,857 | * | 7/1928 | Benner et al. ..... 112/470.16 |
| 1,985,676 | | 12/1934 | Hand . |
| 2,425,301 | * | 8/1947 | Browner . |
| 2,659,187 | | 11/1953 | Barnes . |
| 3,245,680 | | 4/1966 | Harrison et al. . |
| 3,321,889 | | 5/1967 | Zubik et al. . |
| 3,351,992 | | 11/1967 | Carter . |
| 3,429,095 | | 2/1969 | Huson . |
| 3,499,261 | | 3/1970 | Hullhorst et al. . |
| 3,627,306 | | 12/1971 | Affupper . |

(List continued on next page.)

FOREIGN PATENT DOCUMENTS

| | | |
|---|---|---|
| 181590 | 4/1951 | (AT) . |
| 22983/83 | 12/1983 | (AU) . |
| 1 141 610 | 12/1962 | (DE) . |
| 18 96 830 U | 7/1964 | (DE) . |
| 2 225 061 | 5/1972 | (DE) . |
| 0 274 737 | 7/1988 | (EP) . |
| 0 383 501 | 8/1990 | (EP) . |
| 1357816 | 7/1964 | (FR) . |
| 702 049 | 1/1954 | (GB) . |
| 883100 | 11/1961 | (GB) . |
| 2 028 774 | 3/1980 | (GB) . |
| 2 193 734 | 2/1988 | (GB) . |
| 57-47638 | 9/1980 | (JP) . |
| 2-182666 | 7/1990 | (JP) . |
| 155205 A1 | 8/1987 | (RU) . |
| WO 99/35073 | 7/1999 | (WO) . |

*Primary Examiner*—Stephen F. Gerrity
(74) *Attorney, Agent, or Firm*—Darby & Darby

(57) ABSTRACT

A package of a continuous strip of material includes a plurality of parallel side by side stacks each containing a length of the strip which is folded back and forth such that each folded portion of the stack is folded relative to the next portion about a line transverse to the strip and such that the side edges of the strip portions are aligned. The strip of material includes a splice defined by the two ends of the strip. The two ends of the strip are held together by yarn stitches passing through and bridging the strip ends.

7 Claims, 4 Drawing Sheets

U.S. PATENT DOCUMENTS

| | | | | |
|---|---|---|---|---|
| 3,632,103 | | 1/1972 | Nikitits . | |
| 3,645,759 | | 2/1972 | Heiligman . | |
| 3,673,757 | * | 7/1972 | Willis . | |
| 3,684,275 | | 8/1972 | Schweitzer et al. . | |
| 3,697,062 | | 10/1972 | Mones et al. . | |
| 3,729,367 | * | 4/1973 | Shore et al. . | |
| 3,739,544 | | 6/1973 | Hanemann . | |
| 3,780,908 | | 12/1973 | Fitzpatrick et al. . | |
| 3,913,904 | | 10/1975 | Occhetti . | |
| 3,943,864 | | 3/1976 | Feighery et al. . | |
| 3,972,519 | | 8/1976 | Melzer . | |
| 4,053,151 | | 10/1977 | Frezza . | |
| 4,074,901 | | 2/1978 | Catallo . | |
| 4,097,039 | | 6/1978 | Fischer . | |
| 4,174,101 | | 11/1979 | Frezza . | |
| 4,332,583 | | 6/1982 | Stemmler et al. . | |
| 4,406,650 | | 9/1983 | Felix . | |
| 4,427,404 | | 1/1984 | Yamada . | |
| 4,467,589 | | 8/1984 | van Maanen . | |
| 4,493,689 | | 1/1985 | Affupper . | |
| 4,499,707 | | 2/1985 | Desjobert et al. . | |
| 4,512,464 | | 4/1985 | Sylvester . | |
| 4,547,184 | | 10/1985 | Bunch, Jr. . | |
| 4,564,184 | | 1/1986 | Rumpel . | |
| 4,573,670 | | 3/1986 | Felix . | |
| 4,589,361 | * | 5/1986 | Starnes | 112/470.16 |
| 4,597,748 | | 7/1986 | Wolf . | |
| 4,603,817 | | 8/1986 | O'Connor . | |
| 4,670,001 | | 6/1987 | Campbell et al. . | |
| 4,715,915 | | 12/1987 | Hofmeister et al. . | |
| 4,716,706 | | 1/1988 | Boeckmann . | |
| 4,730,762 | | 3/1988 | Felix . | |
| 4,737,045 | | 4/1988 | Koefferlein . | |
| 4,815,405 | * | 3/1989 | Young | 242/556 |
| 4,824,426 | | 4/1989 | DuFresne . | |
| 4,828,540 | | 5/1989 | Fordyce . | |
| 4,829,918 | | 5/1989 | Young, Jr. . | |
| 4,846,454 | | 7/1989 | Parkander . | |
| 4,863,029 | | 9/1989 | Koskol et al. . | |
| 4,907,397 | | 3/1990 | Goodman . | |
| 4,941,374 | | 7/1990 | Focke . | |
| 5,029,828 | | 7/1991 | Sato et al. . | |
| 5,036,977 | | 8/1991 | Schofield et al. . | |
| 5,041,074 | | 8/1991 | Zwimpfer . | |
| 5,042,789 | | 8/1991 | Hediger . | |
| 5,047,003 | | 9/1991 | Schmidlin et al. . | |
| 5,064,179 | | 11/1991 | Martin . | |
| 5,085,624 | | 2/1992 | Felix . | |
| 5,087,140 | | 2/1992 | Keeton et al. . | |
| 5,104,366 | | 4/1992 | Bunch . | |
| 5,147,273 | | 9/1992 | Rottmann et al. . | |
| 5,201,700 | | 4/1993 | Meschi . | |
| 5,205,808 | | 4/1993 | Gebhardt . | |
| 5,242,057 | | 9/1993 | Cook et al. . | |
| 5,290,226 | | 3/1994 | Green, Jr. . | |
| 5,348,527 | | 9/1994 | Beckwith . | |
| 5,358,140 | | 10/1994 | Pellegrino . | |
| 5,529,564 | | 6/1996 | Hediger . | |
| 5,558,318 | | 9/1996 | Crowley et al. . | |
| 5,616,113 | | 4/1997 | Van Den Bergh . | |
| 5,658,638 | | 8/1997 | Pottenger . | |
| 5,690,250 | | 11/1997 | Gooding, Jr. et al. . | |
| 5,730,695 | | 3/1998 | Hauschild et al. . | |
| 5,979,348 | * | 11/1999 | Yaguchi | 112/470.16 |

* cited by examiner

STRIP OF MATERIAL WITH SPLICES AND PRODUCTS FORMED THEREFROM

This application is a continuation in part application of application Ser. No. 08/889,737 filed Jul. 8, 1997 (now U.S. Pat. No. 5,927,051) and of application Ser. No. 09/081,826 filed May 20, 1998 (now U.S. Pat. No. 5,987,851).

This invention relates to a method for forming a strip of material and to a product formed from the strip.

This application is related to applications on this subject matter as follows:

Ser. No. 08/876,402 filed Jun. 16, 1997, now U.S. Pat. No. 5,921,064 issued Jul. 13, 1999;

Ser. No. 08/878,826 filed Jun. 19, 1997, now U.S. Pat. No. 6,035,608 issued Mar. 14, 2000;

Ser. No. 08/906,291 filed Aug. 5, 1997, now abandoned;

Ser. No. 08/939,815 filed Sep. 29, 1997, now U.S. Pat. No. 5,956,926 issued Sep. 28, 1999;

Ser. No. 08/939,444 filed Sep. 29, 1997, now abandoned;

Ser. No. 08/939,881 filed Sep. 29, 1997, now abandoned;

and Ser. No. 08/948,258 filed Oct. 9, 1997, now abandoned.

The disclosure of each of the above applications is incorporated herein by reference.

BACKGROUND OF THE INVENTION

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

In an alternative arrangement the strip is packaged by rolling the strip into a cylindrical pad having a width equal to the width of the strip or is wound into a cylindrical traverse package having a width greater than the width of the strip.

In all of these arrangements, the intention is to limit the number of splices in the strip since these slices cause the material at or on either side of the splice to be scrapped. Splices are necessary in joining the master rolls from which the strips are slit.

The above applications disclose details of an improved method of forming a package of a strip for supply of the strip comprising:

providing a strip having a first side edge, a second side edge, a first surface and a second surface;

forming at least one stack of the strip;

in said at least one stack repeatedly folding the strip back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

arranging the strip portions thus to form a plurality of first fold lines at one end of the stack and a plurality of second fold lines at an opposed end of the stack;

arranging the strip portions thus such that the first surface of each strip portion lies directly in contact with the first surface of one next adjacent portion and such that the second surface of each portion lies directly in contact with the second surface of the other next adjacent portion;

arranging the strip portions with the first side edges thereof lying directly on top of and aligned with the first side edges of others of the strip portions of the stack and with the second side edges thereof lying directly on top of and aligned with the second side edges of others of the strip portions;

arranging the strip portions of the stack with the first and second surfaces thereof generally parallel to a top surface and bottom surface of the stack;

arranging the strip so as to be continuous through the stack between a bottom strip portion and a top strip portion;

placing the entire top surface and the entire bottom surface of the at least one stack under compression in a direction at right angles to the top surface and the bottom surface of the stack;

and engaging the package by a packaging material which maintains the compression.

The package generally includes a plurality of stacks side by side and the stacks include tail portions at the bottom for splicing to another stack to form a continuous strip. Such splicing therefore necessarily increases the number of splices in the finished package.

One particular end use for strips packaged in this way is in the assembly of products using the strip and one or more other layers. The strip is thus covered by at least one layer preferably including one or more top and bottom layers so that the strip itself is not visible by the end user. The strip has characteristics such as absorption or acquisition of fluid which are consistent over the surface and would be compromised if the surface were covered or partly obscured by any material. One example of such products is for use in moisture absorption such as for feminine hygiene products or diapers. The strip is thus formed of a layer of a moisture permeable material which carries an absorption powder or the like. This is assembled with covering layers and stitched or otherwise attached together to form the completed product. The strip is a non-woven material or more particularly an air laid cellulosic material.

The presence of splices in the strip used in such products up to now has been problematic in that the splices which are formed by taping the two ends together using an adhesive strip which can interfere with the characteristics of the strip. The manufacturers have in many cases overcome this problem simply by scrapping or culling the product formed at the splice and at least one product on either side of the splice leading to the abandonment of at least three products for each splice. This material is therefore waste leading to increased cost and in most cases the waste cannot be recycled leading to costs for disposal. It is also necessary to cull the splice in cases where the product is used in the health industry since any materials incorporated into a product of this type must be approved for such use to avoid any possibility of an unacceptable reaction by the user.

SUMMARY OF THE INVENTION

It is one object of the present invention, therefore, to provide an improved product using a strip of this type and an improved method for forming the product.

According to a first aspect of the invention there is provided a product comprising:

a plurality of layers of sheet material at least a first layer and at least one second layer defined by a strip of material;

the layers being assembled in parallel overlying relationship to form a body in which the strip is covered by the first layer;

the strip of material having a splice therein defined by two ends of the strip of material;

the ends being held together by a plurality of yarn stitches passing through the strip of material and bridging the ends of the strip of material;

wherein the splice is arranged such that the strip of material has a surface characteristic at the splice which is substantially equal to that at other locations thereon and is not compromised by the splice.

Preferably the ends of the strip at the splice are arranged in butting relationship without overlap and the ends are held in butting relationship by a plurality of yarn stitches passing through the strip of material and bridging the ends of the strip of material.

Preferably the at least one first layer includes a top layer and a bottom layer and the at least one second layer is arranged between the top and bottom layers.

Preferably the layers are assembled to form a body such that moisture can penetrate through the at least one first layer to access the second layer and wherein the characteristic of the second layer is defined by a response of the second layer to the moisture.

Preferably the second layer is arranged for absorption of the moisture and wherein the second layer comprises a strip of a carrier material and an absorbent material carried thereby and wherein the splice is arranged such that the absorbent layer has a level of absorption at the splice which is substantially equal to that at other locations thereon and is not compromised by the splice.

Preferably the carrier material comprises an air laid cellulosic material.

Preferably the stitches define a first set of yarn portions bridging the splice on one side of the carrier material and a second set of yarn portions bridging the splice on an opposed side of the carrier material.

Preferably the stitches define at least some yarn portions which bridge the butting ends and extend substantially at right angles to the butting ends.

Preferably the stitches define a first set of yarn portions bridging the splice on one side of the material and a second set of yarn portions bridging the splice on an opposed side of the material, both the first and second set of yarn portions including at least some of the yarn portions which extend substantially at right angles to the butting ends.

According to a second aspect of the invention there is provided a method of forming a product including a strip material comprising:

forming a strip of a material;

forming a plurality of longitudinally spaced splices in the strip of material;

each splice being formed by:

cutting two ends of the strip of material;

bridging the two ends by a plurality of yarn stitches passing through the strip of material;

and moving the two ends to a position in which the ends are arranged in butting relationship without overlap;

the ends being held when moved into the butting relationship by the plurality of yarn stitches;

cutting the strip into strip portions some of which include one of the splices therein;

and assembling each of the strip portions into a respective body including a plurality of layers of sheet material including the strip of material.

Preferably at least some of the longitudinally spaced splices are formed when the strip is slit to strip width by taking two ends of the strip and splicing the ends across the width of the strip.

Preferably at least some of the longitudinally spaced splices are formed by providing ends of two webs each having a width greater than that of the strip, splicing the ends of the webs across the width of the webs and slitting the webs into a plurality of side by side strips, the slitting being effected through the spliced ends at right angles to the ends.

According to a third aspect of the invention there is provided a package a strip material comprising:

a strip of a material;

the strip of material being folded back and forth to form a plurality of overlying strip portions;

the package having a width greater than a width of the strip;

the strip of material being continuous and including at least one splice in the strip of material;

the splice being defined by two ends of the strip of material;

the ends being held together by a plurality of yarn stitches passing through the strip of material and bridging the ends of the strip of material.

Preferably the ends of the strip at the splice are arranged in butting relationship without overlap and wherein the ends are held in butting relationship by a plurality of yarn stitches passing through the strip of material and bridging the butting ends of the strip of material.

Preferably the strip has a first side edge, a second side edge, a first surface and a second surface; there is provided a plurality of stacks of the strip; in each stack the strip is repeatedly folded back and forth with the strip continuous through the stack between a bottom strip portion and a top strip portion so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line; the strip portions of each stack thus being arranged to form a plurality of first fold lines at one end of the stack and a plurality of second fold lines at an opposed end of the stack; the strip portions of each stack thus being arranged such that the first surface of each strip portion lies directly in contact with the first surface of one next adjacent portion and such that the second surface of each portion lies directly in contact with the second surface of the other next adjacent portion; the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack; the strip portions of each stack being arranged with the first and second surfaces thereof generally parallel to a top surface and a bottom surface of the stack; the plurality of stacks being arranged side by side with the side edges of the strip portions of each stack effectively immediately alongside the side edges of a next adjacent stack so that the stacks are free from intervening rigid container walls.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

The present invention is concerned with various types of products assembled from one or more strips and associated other layers. These are concerned primarily with feminine hygiene products and diapers where the absorption effect can be compromised but other types of products can also be included where the characteristics of the strip at the splice might otherwise be expected to be affected or compromised at the splice.

Generally, absorption products of this type include a plurality of layers which are assembled by various different techniques including stitching, bonding and the like. Various different layers can be included particularly including an absorption layer which is generally formed from a carrier material which carries an absorption material such as a super absorption polymer. This layer is generally embedded between two or more covering layers so as to define a top layer and a bottom layer. At least one of the top and bottom layers is moisture permeable so as to allow access to the absorption layer. Additional layers may be included such as moisture impermeable or barrier layers, moisture acquisition or spreading layers, deodorant materials and the like. The present invention relates to all such absorption products.

Figure 1:
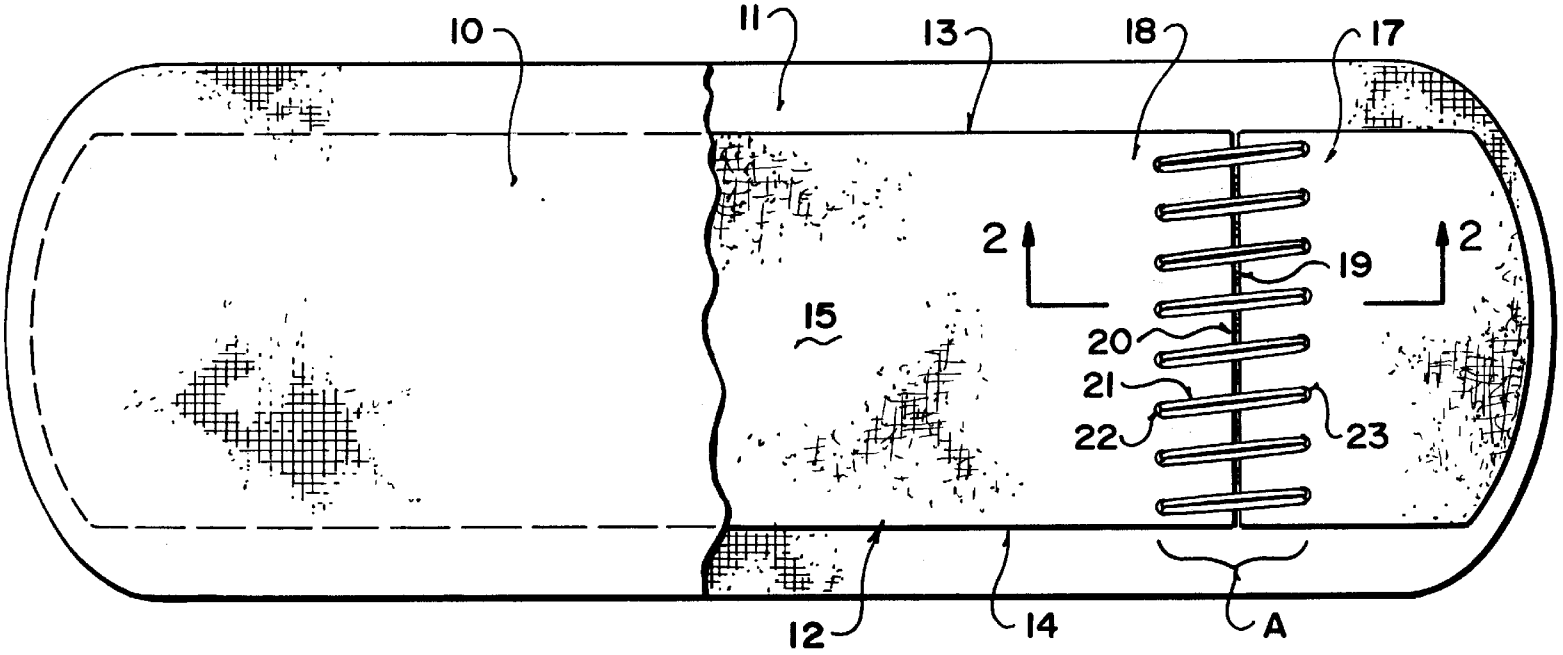
FIG. 1 is a top plan view of a product such as an absorbent pad according to the present invention.
Figure 2:
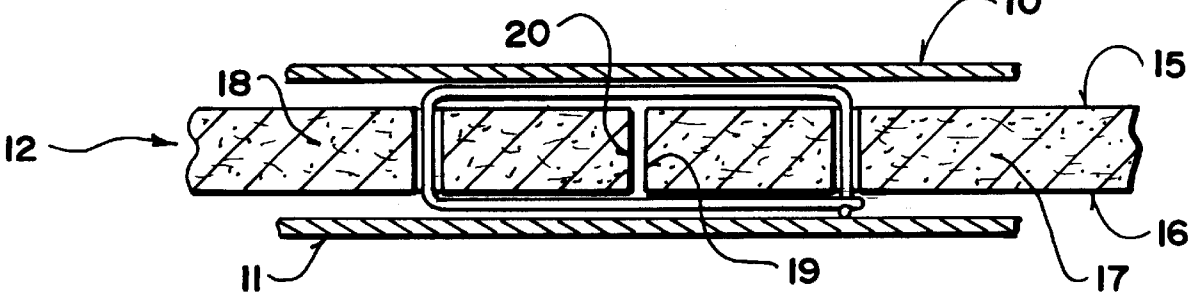
FIG. 2 is a cross-sectional view along the lines 2—2 of FIG. 1.
Figure 3:
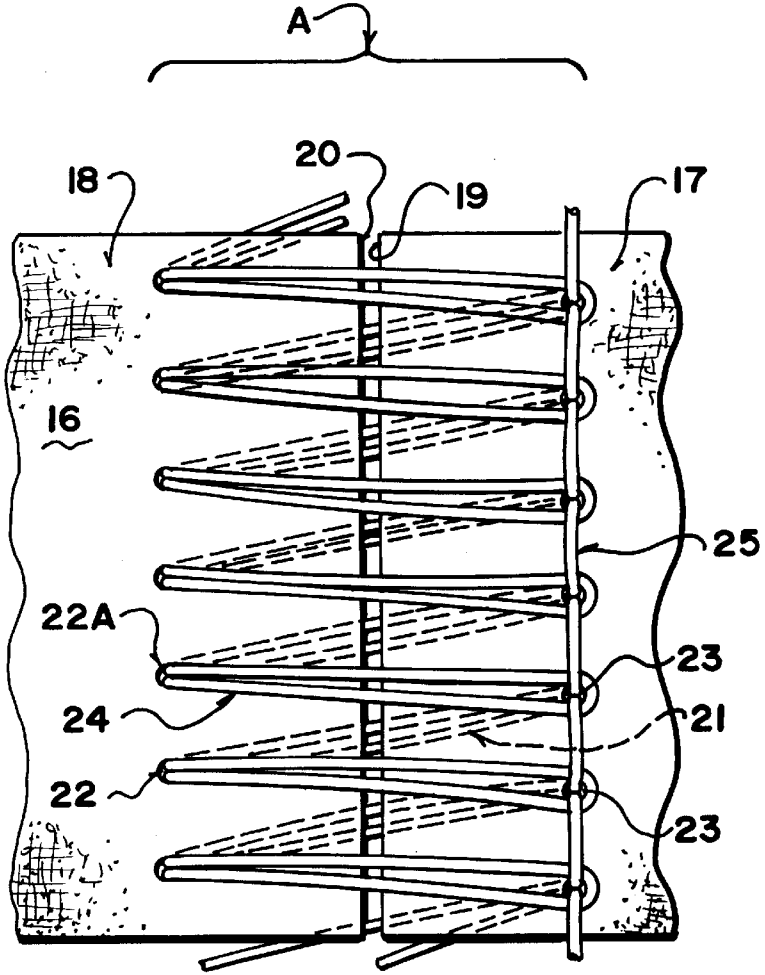
FIG. 3 is a bottom plan view of the pad of FIG. 1 showing the splice area only.

Thus one example is shown in FIGS. 1, 2 and 3 wherein there is provided a top layer 10, a bottom layer 11 and an intermediate absorption layer 12.

The absorption layer 12 is formed from a strip of the material having two side edges 13 and 14, an upper surface 15 and a bottom surface 16. The strip of material is formed from a carrier material within which is provided a suitable absorption material.

In general, the pads are formed in a row by assembling the various layers and by cutting the assembled strips of material to length and to a required shape so that the pads are formed end to end.

It will be appreciated that the strip forming the absorbent layer is supplied in an elongate condition which is as long as possible so as to avoid splices between a tail end of one strip and a leading end of a next strip.

Most of the products will therefore be formed from a portion of the strip which is totally free from a splice since the splices are infrequent. However one of the products is shown in the figures at which is provided a splice between a trailing end 17 of one strip and a leading end 18 of a next strip.

As shown in FIGS. 1, 2 and 3, the splice is formed by butting the ends 19 and 20 of the strip so that there is no overlap at the butting ends. The butt is made as close as possible with little or no space between the butting ends.

The butting ends are held in position by a plurality of stitches 21 spanning the butting ends. Thus the stitches pass through holes 22 and 23 in the ends of the strip and span across the butting ends to hold those butting ends against movement away from each other or side to side.

As shown in the enlarged view of FIG. 3, the holes 22 and 23 are slightly offset and the stitches 21 on the top surface of the strip pass from one hole 22 across the butting ends to one of the holes 23 which is slightly offset. The stitches 24 on the underside of the strip pass across the butting ends on the opposite side from the stitches 21 and move from the hole 23 across to a next adjacent hole 22A. Two yarns pass from each hole to the next to form the stitch lines. A transverse stitch line 25 extends from one hole 23 to the next so that the stitches are locked at the holes 23. Thus the stitches in effect wrap around the fabric strip portions at the butting line and the tension in the stitches prevents the movement of the butting ends. The material of the strip is relatively thick so that the butting ends are inhibited from forming an overlap by the frictional engagement of the butting ends. Side to side movement is prevented since it is necessary to increase the length of the stitches to accommodate such side to side movement. Movement away from each other of the butting ends is prevented by the stitches.

The stitches extend substantially at right angles to the butting ends since the stitch holes are relatively close together and the stitch lines extend diagonally from a hole 22 to a hole 23 and back to the next adjacent hole 22.

As the strip portions are butted at the edges 19 and 20, the area of the splice indicated at A defined between the stitch holes and across the butting ends has an absorption effect which is substantially equal to that of the remainder of the strip. The absorption is thus not in any way comprised by the presence of the stitches nor by the effects of the ends of the strip portions. The stitches are relatively small in comparison with the area involved and accordingly will allow the penetration of moisture to pass the stitches into the absorption layer. As the ends are butting, the moisture engages the top and bottom surfaces of the strip without in any way being affected by the presence of the butting ends.

Contrary to prior art arrangements, therefore, where spliced sections of the strip including the completed pad must be discarded, the splices can be used in the formed pads and the formed pads are equal in operation.

A suitable device for forming spliced ends in the manner shown is manufactured and sold by Elcu Sud Impianti SRL of Milano Italy known as the AAT2000 Butt End Sewing Machine or the TC105 Butt End Sewing Machine. This machine is commercially available and the details of it are available to one skilled in the art so that the details of the machine are not described herein and the details of the stitches formed by the machine or also not described herein.

Figure 5:
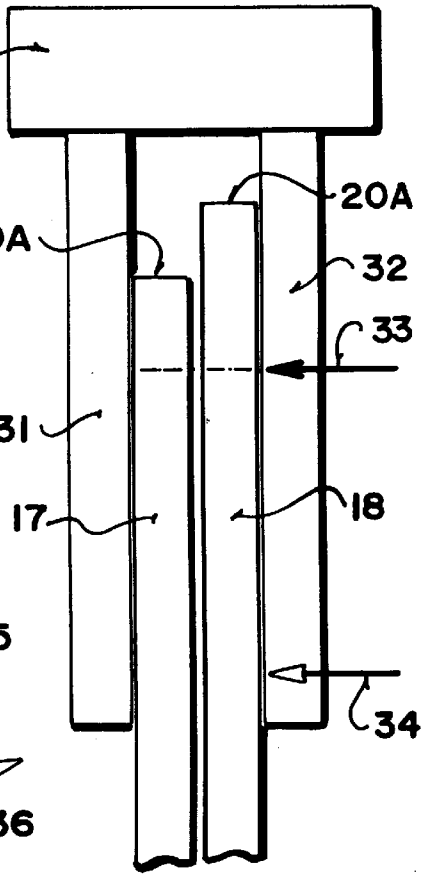
FIG. 5 is an cross-sectional view of the splice area of FIG. 4 showing schematically the splicing head.
Figure 4:
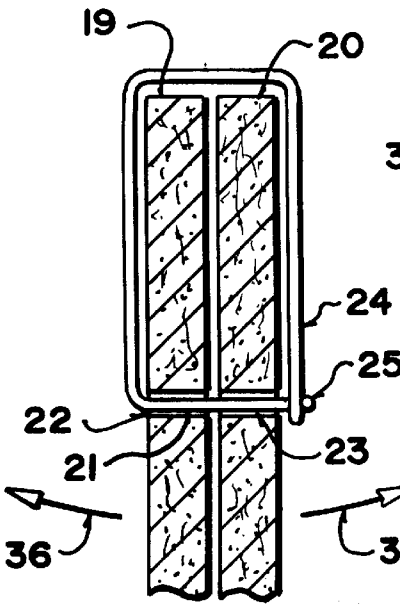
FIG. 4 is a cross-sectional view through the splice area of FIG. 3 prior to folding of the strips into the butting relationship of FIG. 3.

For purposes of simple schematic illustration, the operation of the device is illustrated in FIGS. 4 and 5. In FIG. 5, two ends 17 and 18 of the strip are brought together side by side so that ends 19A and 20A are approximately aligned.

The sewing machine has a head 30 with projecting members 31 and 32 which surround a part of the ends 17 and 18. The head 30 includes a cutting mechanism 33 and a stitching mechanism 34. The cutting mechanism cuts the ends 19 and 20 so that they are directly and accurately aligned and side by side. The stitching mechanism 34 forms a stitch which passes through punched holes 22 and 23 and wraps around the ends 19 and 20. Thus the sewing machine head 30 simultaneously effects a cutting action and a sewing action as the head is moved across the end portions of the strip. When the sewing action is complete, the end portions are moved apart as indicated by the arrows 36 thus moving the end portions each through an angle of 90° from a position in which the ends are adjacent and parallel to a position in which they are lying in a common plane with the ends 19 and 20 butting as shown in FIGS. 1, 2 and 3. This movement requires that the stitch which wraps around the ends and through the holes to be fed through the holes so that the portion on the outside surfaces of the ends is decreased in length while the portion between the inside surface of the ends is increased in length.

The transverse stitch 25 holds the end of the stitch 24 in position at a top of the hole 23 while the stitch 21 is increased in length and the stitch 24 is reduced in length.

The above process is a known process for which the above machine for which the above machine is provided.

However the above machine has not been utilized for absorbent products of the type with which the present invention is concerned and is generally provided for attachment of fabrics.

In order to achieve an effective splice in the above situation it is necessary to ensure that the ends are square to the length of the strip and that the cutting action is effected along a line at right angles to the strip. It is also necessary to ensure that the stitches are arranged at a distance sufficient from the ends of the strip to provide sufficient material to give the strength required to accommodate the forces during handling of the strip. A distance of the order of 0.25 to 0.4 inches is generally acceptable.

Figure 6:
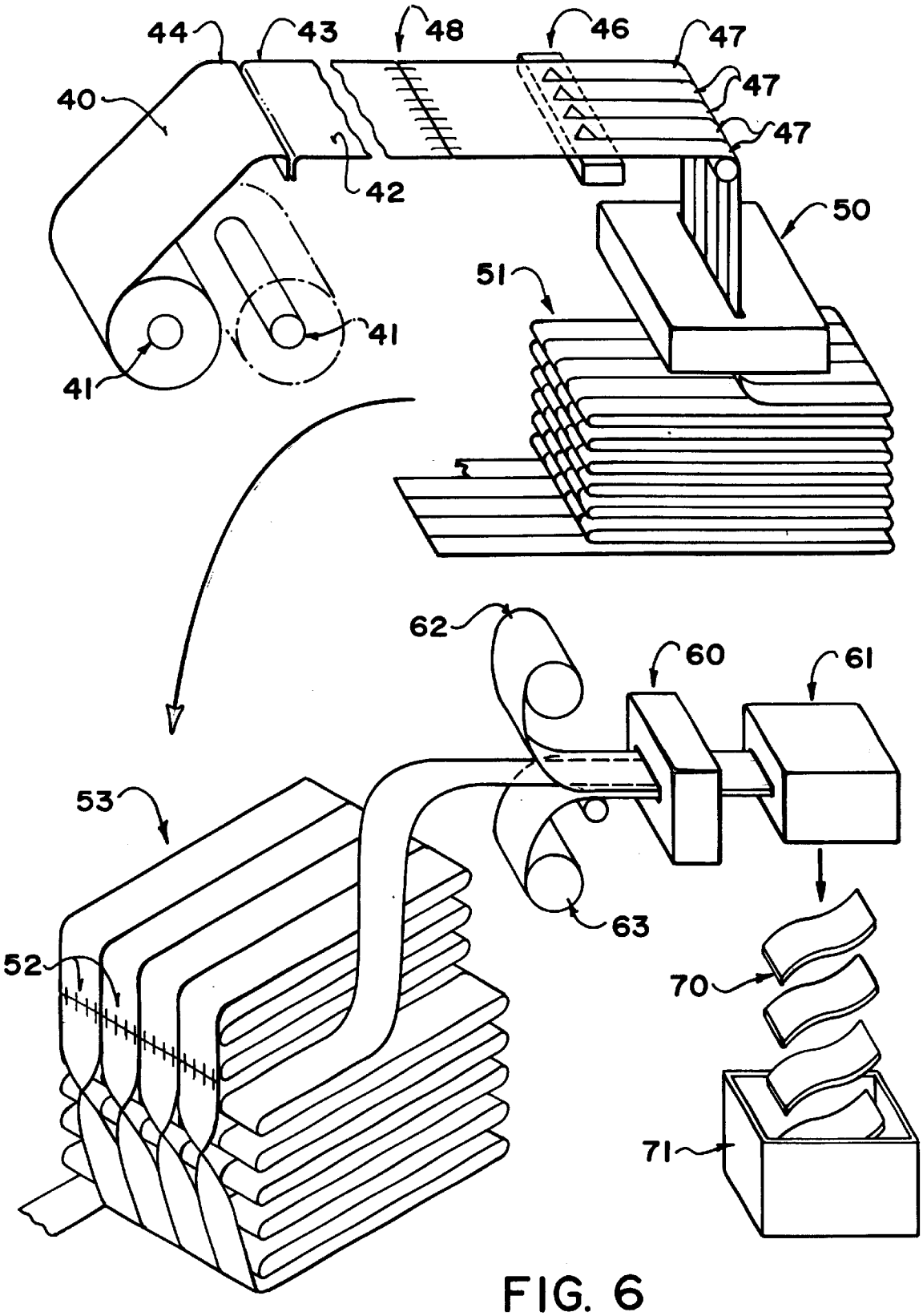
FIG. 6 is a schematic isometric illustration of the method for forming the pad of FIG. 1.

Turning now to FIG. 6, there is shown a method of forming the products of FIGS. 1, 2 and 3 which utilizes the packaging system shown and described in detail in the above identified applications. The disclosure of those applications is therefore incorporated herein by reference.

The packaging method described in those applications includes providing a web 40 of the absorbent layer on a supply roll 41 including a first supply roll and a second replacement supply roll. Thus the first supply roll 41 supplies a web 42 having a trailing end 43 which is supplied when the first supply roll 30 runs out. A leading end 44 of the second supply roll is then attached to the trailing end 43 of the first supply roll using the splicing technique described hereinbefore and the machine identified hereinbefore. Thus the finished splice across the width of the web includes the butting ends and the stitches previously described.

The web is then fed through a slitting station 46 where the web is slit into a plurality of side by side strips 47. The slitting is effected through the splice indicated at 48 with the slitting knives passing at right angles to the butting ends at the splice so that each slit strip has a portion of the splice holding the end of the strip to the leading end of the next strip formed from the next web portion.

The slit strips are fed side by side through a packaging head 50 to form a plurality of stacks of the strip indicated at 51 in the form of a rectangular package. The structure of this package is described in detail hereinafter.

At the ends of the stacks there are further splices 52 which are formed at the strip width by taking the strip from one stack and splicing it to the strip of the next adjacent stack in the manner described in general in the above applications. The splicing technique instead of using conventional tapes to bond the strip portions together utilizes the above described technique and the above described stitches holding the butting ends of the strips together. Thus the finished package indicated at 53 when it is supplied to a second part of the process contains splices both from the web splicing technique and from the individual strip splicing technique. The strip is thus continuous through the package and is unfolded stack by stack through the package to be supplied to an assembling station 60 and a cutting station 61 where the strip is assembled with further layers 62 and 63 and is cut to form the pads described hereinbefore and indicated at 70. The pads are packaged in a packaging station 71.

The present invention has the advantage, therefore, that the particular technique for splicing allows the absorbent strip to retain its absorbency through the splice area without comprising the absorption effect so that the splices can be utilized in the finished product without the necessity for discarding finished pads at or on either side of the splice.

When the strip is assembled into a product as described above, the strip is thus covered by at least one layer preferably including one or more top and bottom layers so that the strip itself is not visible by the end user. The strip has characteristics which are consistent over the surface and would be compromised if the surface were covered or partly obscured by any material. One example of such products is for use in moisture absorption such as for feminine hygiene products or diapers. The strip is thus formed of a layer of a moisture permeable material which carries an absorption powder or the like. The strip is a non-woven material or more particularly an air laid cellulosic material. Another end use in which the present construction is of advantage is in the moisture acquisition layer often used in such absorbent products where the layer acts to spread the moisture along the strip so that it is not concentrated in one area but instead can be absorbed by all areas of the absorbent strip. Other end uses of strips of this type can be found where the surface characteristics of the strip are usually compromised by conventional splices thus requiring culling of the strip portions containing splices. Filter layers have such characteristics.

Figure 7:
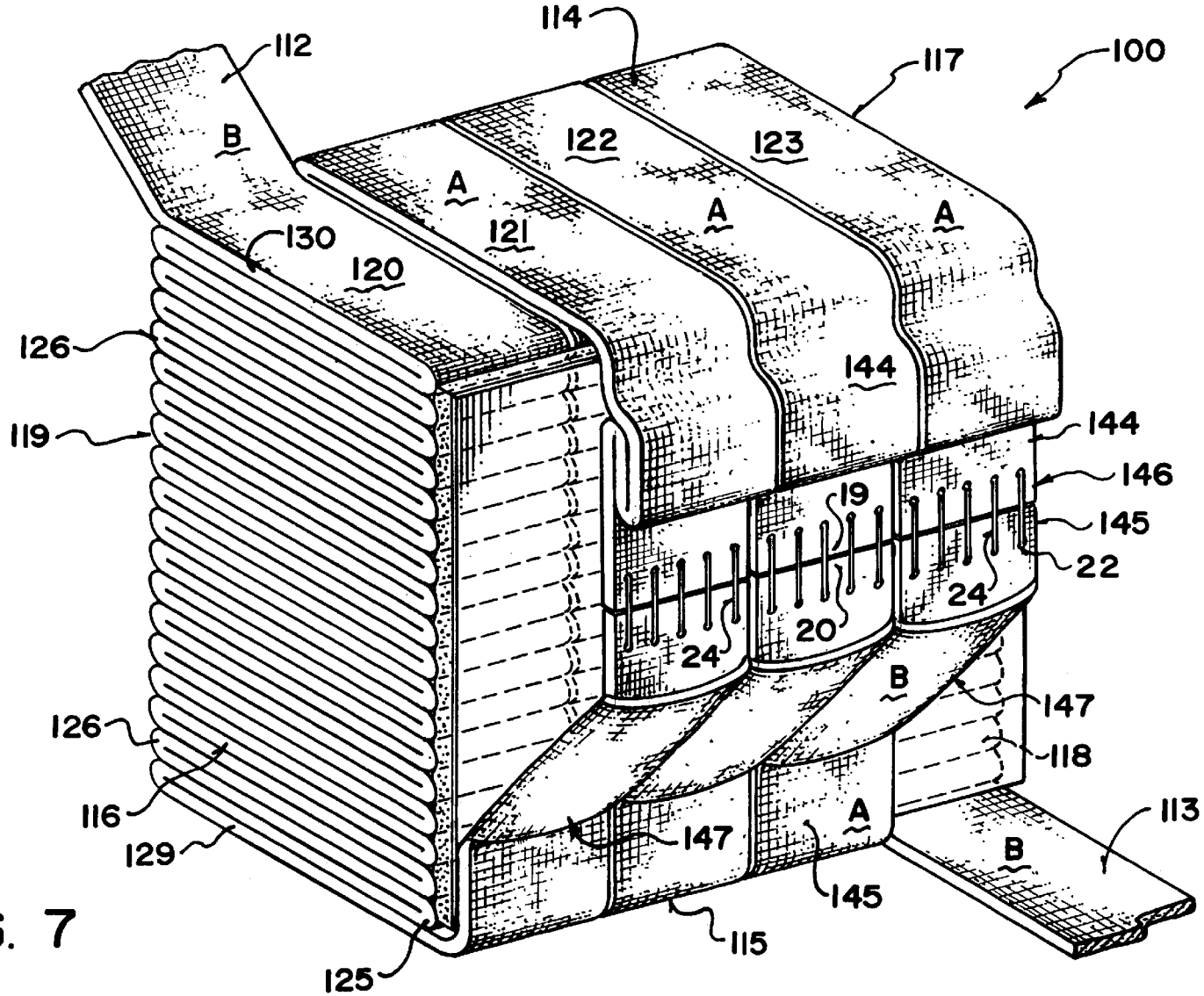
FIG. 7 is an isometric view of a package as shown in FIG. 6 for use in supplying the strip.

Turning now to FIG. 7, an example of a package for supplying the strip is shown. The details of this package are described in one or more of the above specifications, the disclosure of which is incorporated herein by reference.

The package comprises a generally rectangular body 100 formed from a strip or sheet of a pliable material to be packaged and generally this material will be of a fibrous nature formed by woven or non-woven material although this is not essential to the package structure. The strip has a width greater than its thickness so as to define two generally flat surfaces and two side edges. The strip is preferably of constant width but not necessarily so.

The strip has a leading end 112 and a trailing end 113 of the package and otherwise is continuous through the package. The package when oriented in its normal position for transportation or use as shown in FIG. 7 has a top 114, a bottom 115, two sides 116 and 117 and two ends 118 and 119.

The package is formed by a plurality of stacks of strips. In the embodiments shown there are four stacks of the strip indicated respectively at 120, 121, 122 and 123. The stacks are parallel and directly side by side with no intervening elements. The stacks are parallel to the sides 116, 117. The package has end stacks 120 and 123 and a plurality (in this embodiment two) of intermediate stacks.

The term "stack" as used herein is not intended to require that the stacks be vertical or that any particular orientation of the stacks is required. While the stacks are normally formed by placing the strips each on top of the previous to form a generally upright stack, this is not essential to the construction.

It will be appreciated that the dimensions of the package can of course be varied in accordance with the requirement so that the number of stacks, the length of each stack and the height of each stack can be varied within wide limits.

Each stack of the strip comprises a plurality of portions of the strip which are laid on top of one another. Thus as shown in FIG. 7 the portions are folded back and forth to form accordion folded sheets at respective end fold lines 125 and 126 so that the fold lines lie in a common vertical plane defining the ends 118 and 119 of the package. Each portion of the strip lies directly on top of the previous portion so that, with the strip being of constant width. The side edges of the strips of the stacks are therefore aligned and the side edges of the strips of the stacks are also aligned.

Thus the package is formed by laying the portions each on top of the next from a bottom portion 129 up to a top portion 130 to form the stack. The package is thus formed from the plurality of stacks each of which has a length in the direction of the strip portions from which it is formed equal to that of the other stacks and therefore equal to that of the package; and the stacks are formed up to a common height which is therefore equal to the height of the package.

The package is wrapped with a flexible packaging material not shown preferably of heat sealable non-permeable plastics which encompasses the whole of the package. The packaging material is preferably formed as a bag which includes a base and sides with an open top to be closed and wrapped over the package and heat sealed. The package is compressed from the ends 114 and 115 to significantly reduce the height of the package and this compression causes air to be extracted or expelled from the package. The sealed bag is used in a vacuum packaging system to maintain the air outside the bag so that the air pressure outside the bag acts to maintain the package compressed in the height direction and maintains the stacks in contact side by side. The amount of compression and thus the amount of height reduction can be determined so as to minimize the volume of the package without interfering with the required loft of the product when withdrawn from the package. The package defined solely by the stacks and the sealed bag thus defines a free standing rigid structure. In this way the package structure avoids the necessity for rigid sides of a box or similar container so the package structure is stable due to the compression of the stacks to reduce the height of the stacks and due to the pressure of each stack against the sides of the next adjacent stacks.

As shown in FIG. 1, the top end strip portion 130 of each stack 120 generally lays across the top of the stack and has the leading free end 144 at the end 18 which is draped down from the top 114 The end at the top of the stack 120 can be pulled out to form the leading end 112.

The bottom strip portion 129 includes a tail portion 145 which is pulled out from underneath the stack or is formed prior to the formation of the stack as a piece of the strip which hangs out from or beyond the side 18 of the package.

It will be appreciated that the package structure is stationary and therefore readily available for leisurely splicing when it has been moved to the machine to be supplied. Splicing can therefore be effected after the transportation and while the package is awaiting unfolding or even while the first stack 120 is being unfolded. The positioning of the tails 145 upwardly along the side of the package to a position at the top of the package makes the tails readily available so that the packaging material previously described can remain in place with simply the top portion of the packaging material or bag opened or removed to allow access to the top portions 144 and the top end of the tail portions 145.

As shown all of the tail portions 145 are arranged at the end 18 of the package. It is possible that alternate ones of the tail portions are arranged at opposite ends 118 and 119 so that for example the tail portions 145 of the stacks 121 and 123 would be arranged at the end 119.

The splicing is effected such that the surface A of each strip is attached to the surface A of the strip of the next adjacent stack and similarly the surfaces B are also connected. In some cases this is essential as the strip has different surface characteristics. In other cases, this may not be essential to the processing of the strip but in general this is a preferred arrangement to ensure that the strip is supplied in a consistent manner and to avoid twisting of the strip.

Splicing is effected in the manner described above to form the butting ends 19 and 20 and the connecting stitches 24 through holes 22.

In order to ensure that the strip remains without twist as it is unfolded, it is necessary to twist the tail portion 145 in a direction which counters the twist which is introduced into the strip as unfolding transfers from stack 120 to stack 121. Careful analysis of the strips and the process of unfolding will show that the transfer from one stack to the next automatically introduces one turn of twist. It is necessary therefore to counter this turn of twist by a single turn 147 of twist applied to the tail portion prior to splicing at the splice 146.

Preferably this turn of twist is applied at a first fold line at a top of a first portion and a second fold line at a bottom of a portion. The first fold line and the portion are aligned with the stack 20 and the fold line is arranged at an angle of 45° to the horizontal. This forms a horizontal portion of the strip which extends from the fold line to the fold line and is therefore in effect horizontal and at right angles to the normal vertical direction of the tail portion 45 and the portions. The first fold line causes the horizontal portion to lie outside of the vertical portion of the tail portion. The second fold line is arranged so that the vertical portion of the tail portion 45 is inside the horizontal portion. This arrangement introduces one turn of twist while minimising the length of the horizontal portion and providing a tidy arrangement which is aesthetically attractive and which limits the loose parts available of the tail portion 45 which could otherwise interfere and inter-entangle.

The vertical portion of the tail portion 45 then extends vertically up the stack 21 to the splice 46, from which the portion 44 continues up the side of the stack 21 and onto the top of the stack 21.

The horizontal portion is preferably arranged at or immediately adjacent the bottom of the stack 20 so that almost all of the tail portion 45 is supported by the stack 21 as the stack 20 is withdrawn. There is therefore little or no possibility for the tail portion 45 becoming entangled with the strip from the stack 20 as it is withdrawn and prior to the transfer from the bottom portion 29 through the tail 45 to the top portion 44 of the stack 21.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A package of strip material comprising:

a strip of a material wherein the strip has a first side edge, a second side edge, a first surface and a second surface;

there is provided a plurality of stacks of the strip;

in each stack the strip is repeatedly folded back and forth with the strip continuous through the stack between a bottom strip portion and a top strip portion so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack thus being arranged to form a plurality of first fold lines at one end of the stack and a plurality of second fold lines at an opposed end of the stack;

the strip portions of each stack thus being arranged such that the first surface of each strip portion lies directly in contact with the first surface of one next adjacent portion and such that the second surface of each portion lies directly in contact with the second surface of the other next adjacent portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being arranged with the first and second surfaces thereof generally parallel to a top surface and a bottom surface of the stack;

the plurality of stacks being arranged side by side with the side edges of the strip portions of each stack effectively immediately alongside the side edges of a next adjacent stack so that the stacks are free from intervening rigid container walls;

the package having a width greater than a width of the strip;

the strip of material including at least one splice in the strip of material;

the splice being defined by two ends of the strip of material;

the ends being held together by a plurality of yarn stitches passing through the strip of material and bridging the ends of the strip of material.

2. The package according to claim 1 wherein the strip of material comprises a strip of a carrier material and an absorbent material carried thereby arranged such that the strip at the splice has a level of absorption which is substantially equal to that at other locations thereon and is not compromised by the splice.

3. The package according to claim 2 wherein the carrier material comprises an air laid cellulosic material.

4. The package according to claim 1 wherein the stitches define at least some yarn portions which bridge the butting ends and extend substantially at right angles to the butting ends.

5. A package of strip material comprising:

a strip of a material wherein the strip has a first side edge, a second side edge, a first surface and a second surface;

there is provided a plurality of stacks of the strip;

in each stack the strip is repeatedly folded back and forth with the strip continuous through the stack between a bottom strip portion and a top strip portion so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions of each stack thus being arranged to form a plurality of first fold lines at one end of the stack and a plurality of second fold lines at an opposed end of the stack;

the strip portions of each stack thus being arranged such that the first surface of each strip portion lies directly in contact with the first surface of one next adjacent portion and such that the second surface of each portion lies directly in contact with the second surface of the other next adjacent portion;

the strip portions of each stack being arranged with the first side edges thereof lying directly on top of and aligned with the first side edges of others of the strip portions of the stack and with the second side edges thereof lying directly on top of and aligned with the second side edges of others of the strip portions of the stack;

the strip portions of each stack being arranged with the first and second surfaces thereof generally parallel to a top surface and a bottom surface of the stack;

the plurality of stacks being arranged side by side with the side edges of the strip portions of each stack effectively immediately alongside the side edges of a next adjacent stack so that the stacks are free from intervening rigid container walls;

the package having a width greater than a width of the strip;

the strip of material including at least one splice in the strip of material;

the splice being defined by two ends of the strip of material;

wherein the ends of the strip at the splice are arranged in butting relationship without overlap and wherein the ends are held in butting relationship by a plurality of yarn stitches passing through the strip of material and bridging the butting ends of the strip of material.

6. The package according to claim 5 wherein the stitches define at least some yarn portions which bridge the butting ends and extend substantially at right angles to the butting ends.

7. The package according to claim 5 wherein the stitches define a first set of yarn portions bridging the splice on one side of the carrier material and a second set of yarn portions bridging the splice on an opposed side of the carrier material, both the first and second set of yarn portions including at least some of the yarn portions which extend substantially at right angles to the butting ends.

* * * * *

UNITED STATES PATENT AND TRADEMARK OFFICE

CERTIFICATE OF CORRECTION

PATENT NO. : 6,263,814 B1
DATED : July 24, 2001
INVENTOR(S) : Lawrence J. O'Connor It is certified that error appears in the above-identified patent and that said Letters Patent is hereby corrected as shown below:

Column 11,
Lines 64-66, should read -- The package according to claim 1 wherein the stitches define a first set of yarn portions bridging the splice on one side of the strip of material and a second set of yarn portions bridging the splice on an opposed side of the strip of material --.

Signed and Sealed this

Second Day of July, 2002

*Attest:*

*Attesting Officer*

JAMES E. ROGAN
*Director of the United States Patent and Trademark Office*